United States Patent [19]

Gherner

[11] 4,201,117

[45] May 6, 1980

[54] HYDRAULIC MOTOR

[76] Inventor: Lidio Gherner, Via Valdellatorre, 279, 10091 Alpignano (Torino), Italy

[21] Appl. No.: 892,490

[22] Filed: Apr. 3, 1978

[30] Foreign Application Priority Data

Apr. 5, 1977 [IT] Italy ..... 67744 A/77

[51] Int. Cl.[2] ..... F01B 13/04

[52] U.S. Cl. ..... 91/499

[58] Field of Search ..... 91/499, 486, 487

[56] References Cited

FOREIGN PATENT DOCUMENTS

| | | | |
|---|---|---|---|
| 234963 | 11/1960 | Australia | 91/499 |
| 822014 | 10/1959 | United Kingdom | 91/499 |
| 851701 | 10/1960 | United Kingdom | 91/501 |
| 1208157 | 10/1970 | United Kingdom | 91/487 |
| 1398272 | 6/1975 | United Kingdom | 91/499 |

*Primary Examiner*—William L. Freeh
*Attorney, Agent, or Firm*—H. Dale Palmatier

[57] ABSTRACT

A hydraulic motor having a plurality of pistons slidably mounted in a fluid tight manner along respective bores provided axially through a rotor, which is keyed on a central shaft to rotate therewith and within a cavity of an outer casing, said pistons being axially movable with one of their ends in contact with an inclined plate facing one end of said rotor, and said cavity communicating with an inlet and an outlet for a pressurized hydraulic fluid via first and second header means facing the other end of said rotor and communicating with said bores via rotary distribution means formed by a toroidal member cooperating with said header means in a fluid tight manner and connected angularly to said rotor by means of a plurality of key means, each of which engages in a fluid tight manner a respective piston bore of said rotor and is connected to said toroidal member by an articulated joint; duct means being provided through each said key means and said toroidal member to connect each said piston bore to one of said header means.

5 Claims, 5 Drawing Figures

HYDRAULIC MOTOR

BACKGROUND OF THE INVENTION

This invention relates to a hydraulic motor with axial pistons.

In a hydraulic motor of the aforesaid type, a hydraulic operating fluid is fed at a relatively high pressure, which can be of the order of 250–400 atmospheres, to a fixed distribution plate or flange traversed by a central rotatable exit shaft for the motor and facing an axial end of a rotor keyed on to said shaft. Pistons are slidably mounted in bores provided through said rotor, and the axial position of the pistons on the rotor is controlled by a plate facing that end of the rotor farthest from said distribution flange and inclined to the axis of the rotor and therefore of the pistons. These latter are disposed with one of their ends in contact with said inclined plate, such that at any moment during the rotation of the rotor, one half of the pistons is moving away from said flange, while the other half is moving in the opposite direction. Said pressurized fluid acts on the pistons which move towards the inclined plate and which, by cooperating with this latter, cause the rotor to rotate, said fluid being fed through said distribution flange to a front groove therein facing the rotor and constituting a feed header extending over substantially one half of the rotor. The other half of the rotor contains an analogous discharge header to which is fed the fluid leaving the rotor by the effect of the pistons which move towards the distribution flange.

In one particular known hydraulic motor of the aforesaid type, said axial bores or cylinders in the rotor communicate with said feed and discharge headers by way of a rotating distributor constituted by a disc comprising axial appendices on one side which engage in a sealed manner inside said cylinders, and a flat surface on the other side which is arranged to cooperate frontally in a sealed manner with an analogous flat surface provided on said distribution flange, and in which said feed and discharge headers are provided. These latter communicate with the cylinders via axial bores provided through said disc and said appendices.

In general, the proper construction of said rotating distributor requires that two conditions be satisfied at the same time, namely that the said two flat surfaces of the distributor and distribution flange must be perfectly parallel to enable the pressurized fluid to pass therebetween only in the quantity necessary for hydrostatically supporting the rotating distributor with respect to the distribution flange, and the said appendices must engage in the relative cylinders in a perfectly sealed manner. When the normal operating pressure is considered, together with the fact that the position of the axis of the rotor, the rotating distributor of which is angularly rigid with said appendices, is defined relative to the distribution flange by a kinematic chain comprising said central shaft and generally two or more radial bearings, it is immediately obvious that extremely high machining precision is required to simultaneously satisfy the said two conditions, and in the case of rotor diameters exceeding a certain value, this results in commercially unacceptable manufacturing costs.

SUMMARY OF THE INVENTION

The object of the present invention is to provide a hydraulic motor with axial pistons which satisfies both of the aforesaid conditions in a relatively simple and economically acceptable manner.

This object is attained according to the present invention by a hydraulic motor with axial pistons comprising a casing; a central shaft rotatably supported by said casing; a rotor mounted in a cavity in said casing and keyed on to said shaft; a plurality of pistons axially mobile in a sealed manner along respective axial bores provided through said rotor, said pistons being arranged to move with this latter with one of their ends in contact with a plate facing an axial end of said rotor and forming an angle with the axis thereof; first and second header means facing the other axial end of said rotor to connect said cavity to an inlet and outlet respectively for a pressurised fluid; and rotating distribution means disposed in a sealed manner between said head means and the rotor to connect a first and second part of said axial bores to said first and second header means respectively; wherein said rotating distribution means comprise a toroidal member cooperating in a sealed manner with said header means, and a plurality of key means each engaging in a sealed manner in a respective one of said axial bores to angularly connect said toroidal member and said rotor together; each of said key means being connected to said toroidal member by an articulated joint, duct means being provided through each of said key means and through said toroidal member to connect each of said axial bores to one of said header means.

BRIEF DESCRIPTION OF THE DRAWINGS

Further characteristics and advantages of the present invention will be apparent from the description given hereinafter with reference to the accompanying drawings, which illustrate some non-limiting embodiments thereof, and in which.

DETAILED DESCRIPTION OF THE DRAWINGS

Figure 1:
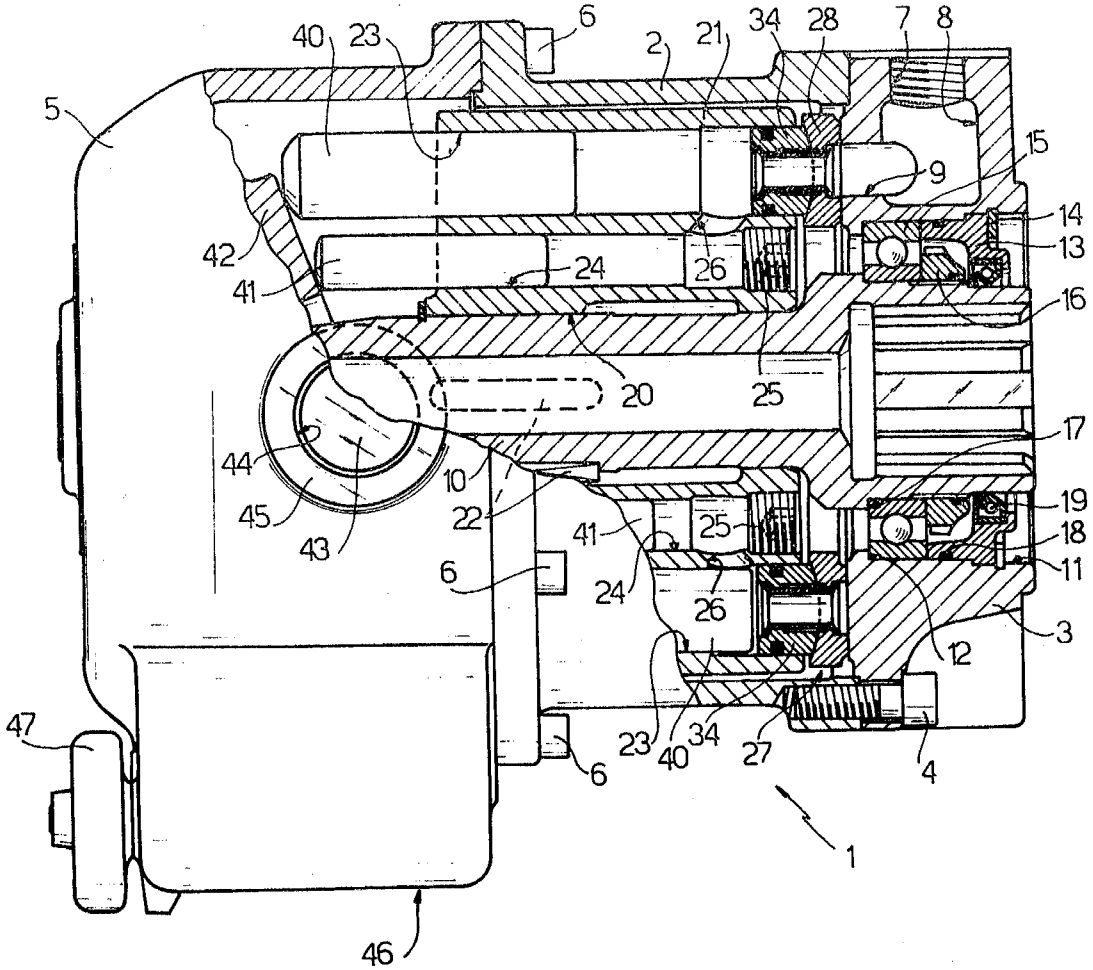
FIG. 1 is a side view, partly in axial section, of a hydraulic motor with axial pistons constructed in accordance with the present invention.

FIG. 1 shows a hydraulic motor with axial pistons, indicated overall by 1 and comprising an outer casing constituted by a hollow cylindrical member 2 closed at one end by a distribution flange or plate 3 joined to the member 2 by screws 4, and at the other end by a cup-shaped cover 5 joined to the member 2 by screws 6.

The distribution flange 3 comprises two radial bores 7 (only one of which is shown in FIG. 1) for feeding and discharging the pressurised fluid, preferably oil, respectively. Each bore 7 opens into a respective chamber 8 provided in the flange 3 and communicating with a respective groove 9 (only one of which is shown in FIG. 1) provided in that surface of the flange 3 which faces the member 2. The two grooves 9 extend along two equal arcs, each less than 180°, of the same circumference coaxial to the member 2.

A hollow shaft 10 supported rotatably but axially fixed by the cover 5 and flange 3 extends axially through the member 2. The flange 3 comprises a central through bore 11 coaxial to the grooves 9 and containing an inner annular shoulder 12, against which the outer ring of a radial ball bearing 15 is axially fixed by an annular member 13 and a retaining ring 14, the inner ring of the bearing being fixed axially by a ring nut 16 against an outer annular shoulder 17 on the shaft 10. The annular member 13 is in sealed contact with the surface of the bofre 11 via a seal ring 18, and with the surface of the shaft 10 via a seal ring 19.

An intermediate portion of the shaft 10 extends through a central through bore 20 provided in a substantially cylindrical drum 21 rotatably mounted in the member 2 and keyed on to the shaft 10 by a plurality of keys 22. The drum 21 constitutes the rotor of the motor 1 and comprises two equal sets of axial cylindrical through bores, indicated by 23 and 24 respectively, and distributed in the form of two concentric rings coaxial to the bore 20 and constituting the axial cylinders of the motor 1. The outer cylinders 23 have a greater diameter than the inner cylinders 24, which in certain applications can be dispensed with. In the example shown, each cylinder 24 is closed at that end thereof facing the flange 3 by a respective threaded plug 25, and communicates with the corresponding cylinder 23 via a respective radial bore 26 provided through the rotor 21 in proximity to the inner end of the relative plug 25.

Figure 2:
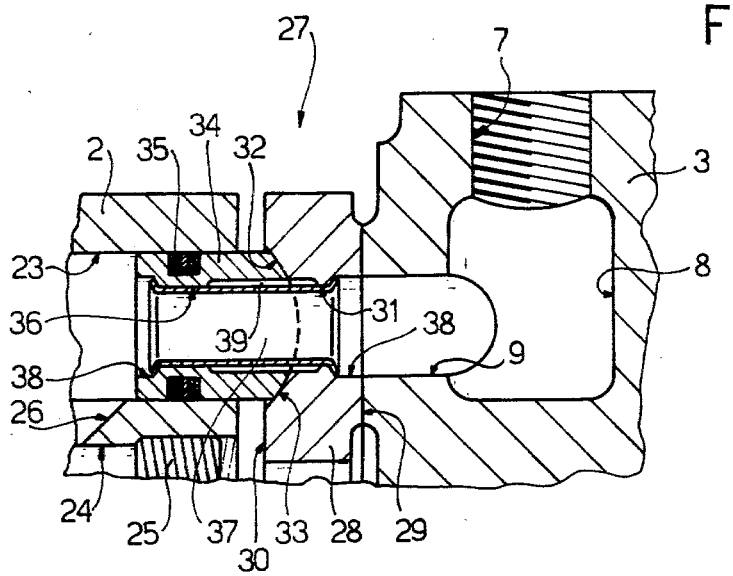
FIGS. 2 and 3 show a detail of FIG. 1 to an enlarged scale and in two different positions.

Between the rotor 21 and flange 3 there is disposed a distribution unit indicated overall by 27 and rotatable with the rotor 21 about the axis of the shaft 10 and in contact with the flange 3. As shown in detail in FIGS. 2 and 3, the distribution unit 27 comprises a toroidal distributor 28 coaxial to the shaft 10 and bounded axially by two flat annular parallel surfaces 29 and 30, the first of which is arranged to slide substantially in contact with the flange 3 to axially close the grooves 9 thereof. The toroidal distributor 28 is traversed by a number of axial through bores 31 equal to the number of cylinders 23 and uniformly distributed along a circumference which is coaxial to the grooves 9 and having a radius substantially equal to the mean radius of these latter. In the surface 30 of the distributor 28 at each bore 31, there is provided a cavity 32 in the shape of a spherical cap which is coaxial to the relative bore 31 and in contact with a spherical surface 33 of equal radius provided at one end of a respective cylindrical plug 34 engaged in a sealed manner via a resilient seal ring 35 in a respective cylinder 23.

Each bore 31 communicates with the interior of a respective cylinder 23 through an axial through bore 36 provided in the respective cylindrical plug 34, which is axially fixed to the distributor 28 by a tube 37, preferably of brass, extending in a sealed manner along said bores 31 and 36. In order to enable the plugs 34 to be fixed axially to the distributor 28, each bore 31 and the corresponding bore 36 comprise an enlarged portion 38 at their opposite ends, to define an annular shoulder against which one end of the respective tube 37 is flared, to assume substantially the shape of a rivet for connecting the relative plug 34 to the distributor 28, and keep the said surface 32 and 33 constantly in contact to define the ball joint for connecting said plug 34 to said distributor 28. In order to enable each tube 37 to deform axially, an annular expansion cavity 39 is provided along each pair of bores 31, 36 external to a central portion of the relative tube 37.

As shown in FIG. 1, cylindrical pistons indicated by 40 and 41 respectively are slidably mounted in a sealed manner such that they can rotate about their axis in cylinders 23 and 24, the length of the pistons preferably exceeding three times their diameter, and their stroke being controlled by a plate 42 arranged to cooperate with that end of the pistons 40 and 41 facing the flange 3. The plate 42 is supported by the cover 5 via two radial coaxial pins 43 perpendicular to the shaft 10, each of which rotatably engages in a relative bore 44 provided through a lug 45 on the plate 42. The angular position of this latter about the axis of the pins 43, i.e. the inclination of the plate 42 to the shaft 10, can be adjusted by an adjustment device 46 housed in the cover 5 and operated in the example illustrated by a knob 47.

When in operation, the drive fluid fed under pressure to the feed bore 7 reaches one of the grooves 9, which acts as a feed header for said fluid to the cylinders 23 and 24 which communicate with it through the relative tubes 37 of the distribution unit 27. The said cylinders are urged to cooperate, by way of that end thereof opposite the one facing the flange 3, with the inclined plane defined by the plate 42, along which they move both axially and transversely to rotate the rotor 21 and thus the shaft 10.

On reaching the top dead centre, each pair of cylinders 23, 24 becomes connected via the respective tube 37 to the other of the grooves 9 which acts as a discharge header, to convey towards the discharge bore 7 the fluid expelled from the cylinders the pistons of which move towards the flange 3 while keeping in contact with the plate 42.

Figure 3:
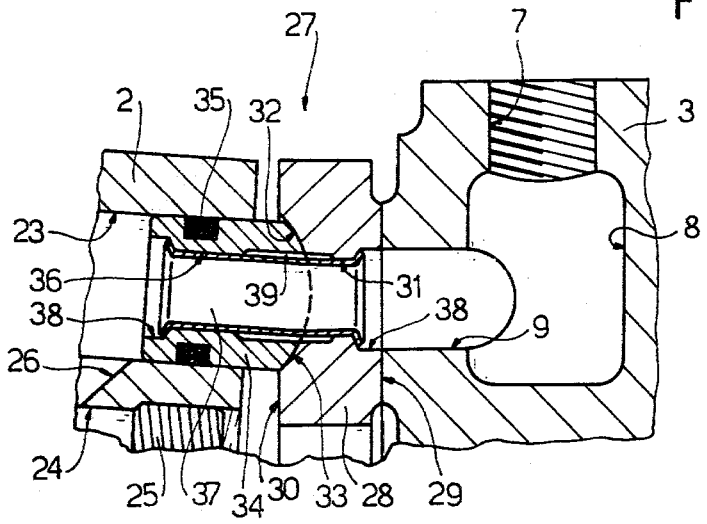

As illustrated in a much exaggerated manner in FIG. 3, the articulated structure of the unit 27 enables all the constructional imperfections of the motor 1 to be compensated, so allowing substantially perfect coplanarity between the surface 29 and the surface of the flange 3 facing it to be attained, together with a substantially perfect seal between the plugs 34 and the interior of the relative bores 23, in spite of the bending stresses to which the plugs 34 are subjected when functioning as keys for angularly connecting the distributor 28 to the rotor 21.

Figure 4:
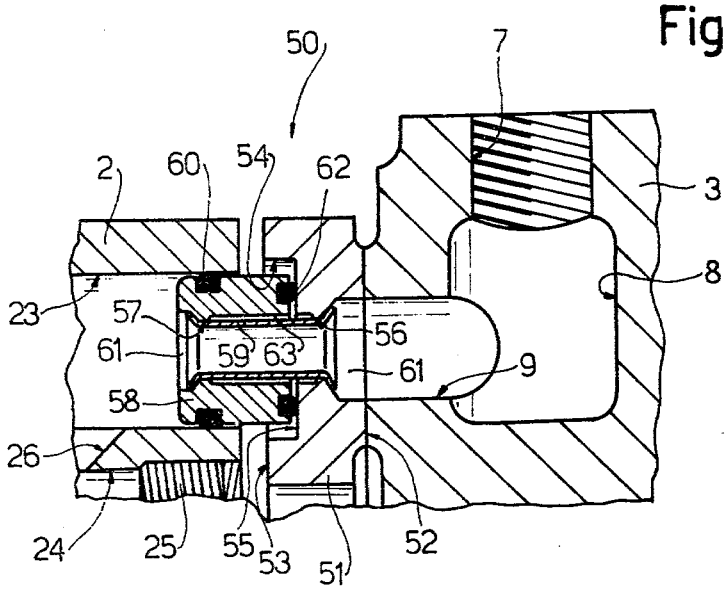
FIGS. 4 and 5 show one modification of the detail of FIGS. 2 and 3 to an enlarged scale and in two different positions.
Figure 5:
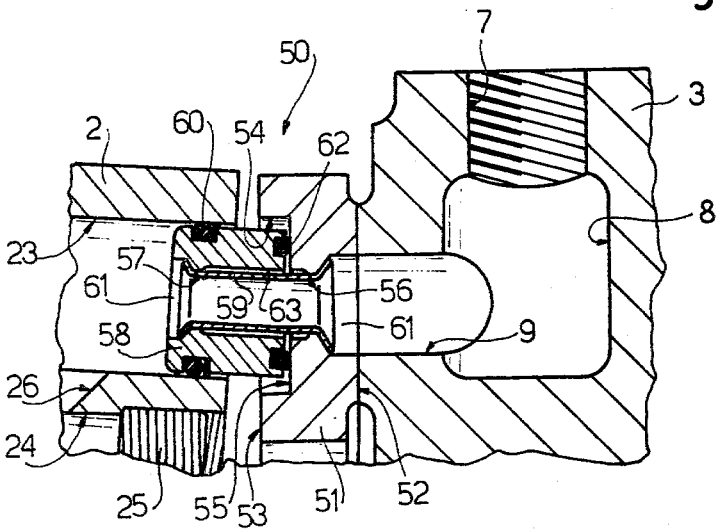

A result analogous to that obtained with the distribution unit 27 can be obtained by replacing it by a different distribution unit indicated overall by 50 and illustrated in FIGS. 4 and 5.

The distribution unit 50 comprises a toroidal distributor 51 coaxial to the shaft 10 and bounded axially by two annular flat parallel surfaces 52 and 53, the first of which is arranged to slide substantially in contact with the flange 3 to axially close the grooves 9 therein, and the second comprises an annular groove 54 of substantially rectangular cross-section overlying the grooves 9 and comprising a flat base surface 55 parallel to the surface 52.

The toroidal distributor 51 is traversed by a number of axial through bores 56 equal to the number of cylinders 23 and uniformly distributed along a circumference which is coaxial to the grooves 9 and has a radius substantially equal to the mean radius of these latter.

Each bore 56 communicates with the interior of the respective cylinder 23 through an axial through bore 57 provided in a respective cylindrical plug 58 which is fixed axially to the distributor 51 by a tube 59, preferably of brass and extending in a sealed manner along said bores 56 and 57, and engages in a sealed manner in the relative cylinder 23 via a resilient seal ring 60.

In order to enable the plugs 58 to be fixed axially to the distributor 51, each bore 56 and the corresponding bore 57 comprise at their opposing ends an enlarged portion 61 which defines an annular shoulder against which one end of the respective tube 59 is flared to assume substantially the form of a rivet for connecting the relative plug 58 to the distributor 51. The deformation of the ends of the tubes 59 compresses each plug 58 against the surface 55 of the groove 54 via a resilient support ring 62, which together with the relative tube 59 forms a flexible coupling which, as shown in FIG. 5, serves in a substantially similar manner to that of the ball joint connecting the plugs 34 of the distribution unit 27 to the relative distributor 28.

In the case of the distribution unit 50, an annular cavity 63 is again provided along each pair of bores 56 and 57 to allow the relative tube 59 to deform.

Numerous modifications can be made within the concept of the invention to the hydraulic motors described by way of example only, without leaving the scope of the present invention.

What I claim is:

1. A hydraulic motor with axial pistons comprising a casing; a central shaft rotatably supported by said casing; a rotor mounted in a cavity in said casing and keyed onto said shaft; a plurality of pistons axially mobile in a sealed manner along respective axial bores provided through said rotor; said pistons being arranged to move with this latter with one of their ends in contact with a plate facing an axial end of said rotor and forming an angle with the axis thereof; first and second header means facing the other axial end of said rotor to connect said cavity to an inlet and outlet respectively for a pressurized fluid; and rotating distribution means disposed in a sealed manner between said header means and the rotor to connect a first and second part of said axial bores to said first and second header means respectively; said rotating distribution means comprising a toroidal member cooperating in a sealed manner with said header means, and a plurality of key means each engaging in a sealed manner in a respective one of said axial bores to angularly connect said toroidal member and said rotor together; each of said key means being connected to said toroidal member by an articulated joint, duct means being provided through each of said key means and through said toroidal member to connect each of said axial bores to one of said header means, and said articulated joint including an elastically deformable tubular rivet extending in a sealed manner along the respective said duct means and gripping against opposing surfaces of the relative key means and said toroidal member.

2. A motor as claimed in claim 1, wherein said articulated joint is a ball joint.

3. A motor as claimed in claim 2, wherein each of said key means comprise a plug engaged in a sealed manner in the relative axial bore via a resilient seal ring, and comprising a convex end in the form of a spherical cap coaxial with the relative said duct means and in contact with a corresponding cavity in the form of a spherical cap provided in said toroidal member.

4. A motor as claimed in claim 1, wherein said articulated joint is a flexible coupling.

5. A motor as claimed in claim 4, wherein each of said key means comprises a plug engaged in a sealed manner in the relative axial bore via a resilient seal ring, and comprising an end surface in contact with a corresponding surface of said toroidal member via resilient support means.

* * * * *